US008640763B1

(12) United States Patent
Laengle et al.

(10) Patent No.: US 8,640,763 B1
(45) Date of Patent: Feb. 4, 2014

(54) DEVICE AND METHOD FOR FACILITATING THE DELIVERY OR MOVING OF OVERSIZED FURNITURE ITEMS

(76) Inventors: Judith C. Laengle, Boca Raton, FL (US); Lynn Sciarrone, Boca Raton, FL (US)

( * ) Notice: Subject to any disclaimer, the term of this patent is extended or adjusted under 35 U.S.C. 154(b) by 0 days.

(21) Appl. No.: 13/475,450

(22) Filed: May 18, 2012

Related U.S. Application Data

(63) Continuation of application No. 13/211,797, filed on Aug. 17, 2011.

(60) Provisional application No. 61/374,598, filed on Aug. 17, 2010.

(51) Int. Cl.
*A47G 5/00* (2006.01)

(52) U.S. Cl.
USPC ..... 160/351

(58) Field of Classification Search
USPC ..... 160/351; 52/741.3, 3, 211, 506.01
See application file for complete search history.

(56) References Cited

U.S. PATENT DOCUMENTS 1,719,364 A * 7/1929 Gilkey ..... 27/19
2,837,787 A * 6/1958 Wright ..... 52/717.01
D239,688 S * 4/1976 Doman et al. ..... D7/698
4,405,673 A * 9/1983 Fridley et al. ..... 428/80
4,483,380 A * 11/1984 Beran ..... 206/315.1
4,768,320 A * 9/1988 Weller ..... 52/211
5,351,733 A * 10/1994 Ullman ..... 150/154
D359,664 S * 6/1995 Alley ..... D7/698
5,501,441 A * 3/1996 Kegley ..... 269/289 R
D370,602 S * 6/1996 Kegley ..... D7/698
5,799,443 A * 9/1998 Koeniguer ..... 49/383
5,968,641 A * 10/1999 Lewis ..... 428/298.1
6,216,396 B1 * 4/2001 Katz ..... 52/2.11
D441,261 S * 5/2001 Stein ..... D7/698
6,357,187 B1 * 3/2002 Haldeman ..... 52/211
6,381,910 B1 * 5/2002 Katz ..... 52/211
6,526,708 B1 * 3/2003 Hartley et al. ..... 52/211
6,703,102 B1 * 3/2004 Prescott ..... 428/76
6,718,706 B2 * 4/2004 Katz ..... 52/211
6,829,863 B2 * 12/2004 Lovas ..... 52/211
6,932,336 B1 * 8/2005 Nudo ..... 269/302.1
7,097,243 B2 * 8/2006 Verbovszky ..... 297/219.12
7,228,668 B2 * 6/2007 Gibney et al. ..... 52/506.01
7,398,612 B2 * 7/2008 Zheng ..... 40/603
7,571,503 B2 * 8/2009 Gabriel ..... 5/636
7,897,225 B2 * 3/2011 Campbell et al. ..... 428/36.5
7,914,611 B2 * 3/2011 Vrzalik et al. ..... 96/11

(Continued)

*Primary Examiner* — Katherine Mitchell
*Assistant Examiner* — Johnnie A Shablack
(74) *Attorney, Agent, or Firm* — Allen D. Hertz, P.A.; Allen D. Hertz

(57) ABSTRACT

The present invention relates to a portable, protective barrier for facilitating the passage of oversized articles through a span provided between two barriers. The protective barrier is fabricated of a board having a first planar surface and an opposite planar surface defined by a peripheral edge. The protective barrier is placed between the article being transferred through the span and at least one of the barriers. The article is compressed against the protective barrier to facilitate movement of the article through the span. The article can be furniture, appliances, equipment, etc., and the barriers can be a corner, a wall, a doorjamb, a staircase, other furniture, artwork, etc. The protective barrier may include a smooth planar surface enhancing passage of the article through the span. A non-skid texture may be applied to the opposite surface to increase friction between the protective barrier and the respective edge of the span.

17 Claims, 9 Drawing Sheets

(56) References Cited

U.S. PATENT DOCUMENTS

2004/0119220 A1* 6/2004 Davis ..... 269/289 R
2008/0048376 A1* 2/2008 Farmer et al. ..... 269/289 R
2010/0281783 A1* 11/2010 Harrington ..... 52/2.23
2012/0222192 A1* 9/2012 Carey et al. ..... 2/171.2

* cited by examiner

DEVICE AND METHOD FOR FACILITATING THE DELIVERY OR MOVING OF OVERSIZED FURNITURE ITEMS

CROSS-REFERENCE TO RELATED APPLICATIONS

This U.S. Non-Provisional application is a Continuation-In-Part, which claims priority to co-pending U.S. Non-Provisional application Ser. No. 13/211,797, filed on Aug. 17, 2011, which claims priority to U.S. Provisional Patent Application Ser. No. 61/374,598, filed on Aug. 17, 2010, both of which are incorporated herein in their entireties.

FIELD OF THE INVENTION

The present invention relates generally to protective devices for use in moving furniture or other objects. More particularly, the present disclosure relates to a portable device used for facilitating the delivery or moving of oversized items, including furniture, appliances, equipment, and the like, and in parallel, protecting the object being moved and adjacent items such as walls, doorways, doorjambs, and the like from being damaged.

DESCRIPTION OF THE PRIOR ART

Moving household furniture or appliances from one location to another or into storage is a burdensome task that often requires the assistance of others or hiring a moving company. Office buildings typically hire moving companies to move office equipment from one office building to another. Moving companies generally employ trained and skilled individuals and provide the necessary equipment for effectively and safely moving, loading, and unloading articles from one location to a desired destination. The furniture typically passes through doorways, hallways, into and out of elevators, and the like during the moving process. Throughout the moving process, the exposed surfaces, edges and corners of the articles being moved (such as furniture, appliances, office equipment, and the like) can inadvertently come in contact with structural features such as walls, doors, doorjambs, and the like causing damage to either or both of the articles being moved and the adjacent structural features which may inadvertently contact the subject articles. Articles being moved have a tendency to frictionally engage with walls, doors, doorjambs, and the like, whereby the contact can cause damage to article being moved, wall paper, scratch painted walls, leave dents or score marks in the walls, or cause other undesirable damage thereof. In addition, moving equipment, such as dollies, or hand trucks, also poses a risk of damage to the structural features, as their metal frames or wheels often bang or rub against them.

In an effort to reduce the risk of damage, individuals and moving companies utilize a number of different devices to protect the articles being moved and structural features that may contact such articles during the transportation process to avoid damage to either object. For example, it is typically common practice thr moving companies to use padded or quilted blankets that are wrapped around the article being moved to protect the article from damage. Such conventional quilted blankets are generally satisfactory for protecting furniture from damage during transport or storage but offer limited protection to structural features as the articles pass therethough. The blankets fail to protect against dents, breakage, scoring, and other damage to the structural features, as they are not intended to absorb impact. If the blankets are not securely attached to the furniture, they often slip off the furniture exposing the furniture to possible damage. Placing the quilted blankets on furniture is also time consuming, and requires a number of straps to adequately secure the blankets in place. In addition, a large number of quilted pads are often needed for larger moves. The blankets are very heavy and cumbersome, increasing the volume when passing through a tight space. The blankets can become dislodged introducing a potential risk for injury to the mover.

Other forms of protective devices are also known. One such example is the use of corrugated cardboard that is displaced about a room to protect walls, and doorjambs. Another is the use of padded coverings that are placed about legs, feet, or tops of tables. These are all placed about the article being moved.

Other embodiments are located about the structural features, such as removable and reusable guards that are secured to doorjambs using a variety of different fasteners to secure the guards in place and protective shields placed on walls to protect the wall from damage. To protect flooring, skid pads can be placed under the feet of furniture enabling the mover to slide the furniture on the floor and avoid incurring any damage.

Another protection solution utilizes barrier-type protection such as hanging padded curtains for use inside elevators and along stairways Hanging mats are often secured along the inner walls of elevators to provide protection to the interior panels of the elevators.

Door protectors, dimensioned to correspond to the height and width of a door, are also used to protect main entrance doors from damage due to contact with moving furniture. Such door protectors are securely hung on doors or removably attached to doors using a variety of fasteners.

Although the conventional prior art devices provide some protection to furniture, walls and doorjambs from damage when moving furniture, such devices have certain drawbacks. For example, many prior art devices are cumbersome and time consuming to install or fasten as many require a number of straps or fasteners to secure the protective barrier in place. Many conventional devices serve a single purpose such as being designed to protect only a doorjamb, or door or provide protection for a wall. Another drawback of conventional devices is that most devices are permanently installed in one location and fail to provide a portable, protection barrier that can be used from place to place when moving articles in and out of a room, house or building. Padded covers are bulky to use, and often tear over time. Movers' typically don't take the time to adequately strategize a damage prevention plan before moving furniture, and thus, the move is frequently initiated without properly protecting the furniture, walls, doors or doorjambs beforehand.

What is desired is a portable, protection device that is quick and easy to use, and beneficial for facilitating moving any of a variety of different articles such as furniture, equipment, appliances, and the like, while protecting the articles being moved as well as any structural features which may contact the articles being moved such as furniture, walls, doorjambs, and the like from being damaged.

SUMMARY OF THE INVENTION

Accordingly, it is a primary object of the present invention to provide a portable device that is lightweight, and easy to use for facilitating the moving of oversized articles, such as furniture, appliances, office equipment, and the like, that facilitates the move and prevents damage to the articles being moved as they pass through or by structural features or other objects. Examples of structural features can include walls, doorways, doorjambs, stairways, staircase railings, built in units, cabinets, corners, and the like. Other objects that may impact or become damaged during the moving process include furniture, art, and the like.

In another aspect of the present invention there is provided a portable, protective device for facilitating the delivery or moving of oversized articles. The portable device is preferably fabricated of a rectangular flexible board comprising a handle and having at least one side with a smooth, slippery texture. The portable device is placed between the article being moved and a structural feature which the article will pass by during a move for protecting both, the article being moved and the structural feature from damage. The smooth, slippery surface allows the furniture to slide across the surface of the board with ease. It is further recognized that the portable, protective device enables the moving parties to compress the article being moved against the portable, protective device to aid in the passage of the article through any tight spans such as a doorway, a walkway, and the like. This feature is particularly beneficial for articles such as upholstered furniture.

In yet another aspect of the invention there is provided a method of protecting furniture items, walls, doors and doorjambs during delivery and moving of the furniture items, the method comprising the steps of obtaining a portable protective barrier comprising: a board having rounded corners and two opposite surfaces, at least one of the surfaces having a smooth, slippery texture; a handle formed proximate one edge of the board, the handle defined by a full depth cut out; grasping the handle of the protective barrier with one hand, and positioning the portable protective barrier between the furniture items and a wall, doorjamb, or a door to protect the furniture items, the wall, doorjamb and door from damage.

These and other advantages of the invention will be further understood and appreciated by those skilled in the art by reference to the following written specifications, claims, and appended drawings.

BRIEF DESCRIPTION OF THE DRAWINGS

The invention will now be described, by way of example, with reference to the accompanying drawings, in which.

DETAILED DESCRIPTION OF REPRESENTATIVE EMBODIMENTS

Figure 1:
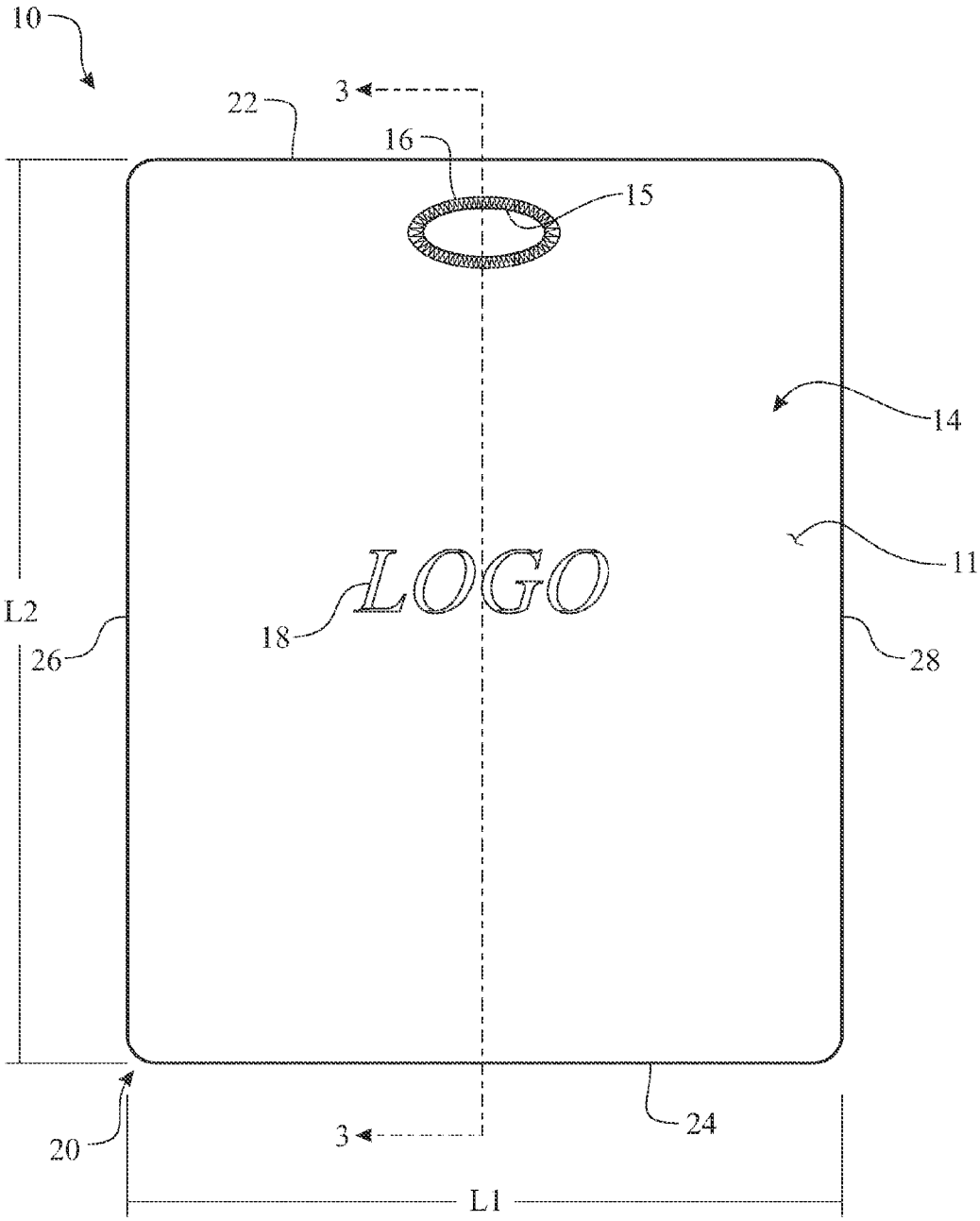
FIG. 1 presents a front plan view of a portable, protection device used for facilitating moving and preventing damage to articles such as furniture, appliances, office equipment and the like during the moving process.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring now to the figures wherein like numerals represent like elements throughout. An exemplary portable, protective barrier 10 is introduced in FIGS. 1 and 2, wherein a front view is presented in FIG. 1 and a side view is presented in FIG. 2. The portable, protective barrier 10 is provided for facilitating moving of articles, such as furniture, appliances, office equipment, and the like, through tight spans, such as doorways, doorjambs, stairways, and the like. The portable, protective barrier 10 provides two key benefits to the mover, the first being protection of both the article being moved and any object or structural feature that the article passes by, the second being the facilitation of passing the article through a tight span. The mover can compress the article against the object, sliding the article against the portable, protective barrier 10 to optimize the use of the distance between the span. Additionally, when the article can be compressed, such as when moving a couch or sofa, the portable, protective barrier enables the movers to effectively gain additional clearance from the opposite or unprotected edge of the span. The term compress can be broadened to include positioning the article against the portable protection barrier 10 to optimize clearance between the article and the opposite surface defining the span.

In the preferred embodiment of the present invention, the portable protection barrier 10 comprises a flexible, or semi-flexible, rectangular board 14 having a handle 15. The rectangular hoard 14 is fabricated of a generally planar, solid material bound by a board peripheral edge 20. The board peripheral edge 20 includes a first grip edge 22, a second grip edge 24 located opposite the first grip edge 22, a first elongated edge 26 spanning between a first end of the first grip edge 22 and second grip edge 24 and a second elongated edge 28 located opposite the first elongated edge 26 and spanning between a second end of the first grip edge 22 and second grip edge 24. It is understood that the definition and number of sides 22, 24, 26, 28 may differ based upon the shape of the board peripheral edge 20. A width of the rectangular board 14, or length of sides 22, 24, is referenced by dimension "L1". A length of the rectangular board 14, or length of sides 26, 28, is referenced by dimension "L2". The peripheral edge has a thickness referenced by dimension "T". A first primary surface is referred to as a first side surface 11. The first side surface 11 spans across a continuous first edge of the peripheral edge 20. A second primary surface is referred to as a second side surface 12. The second side surface 12 spans across a continuous second edge of the peripheral edge 20. The second side surface 12 is oriented parallel to and opposite of the first side surface 11.

Figure 2:
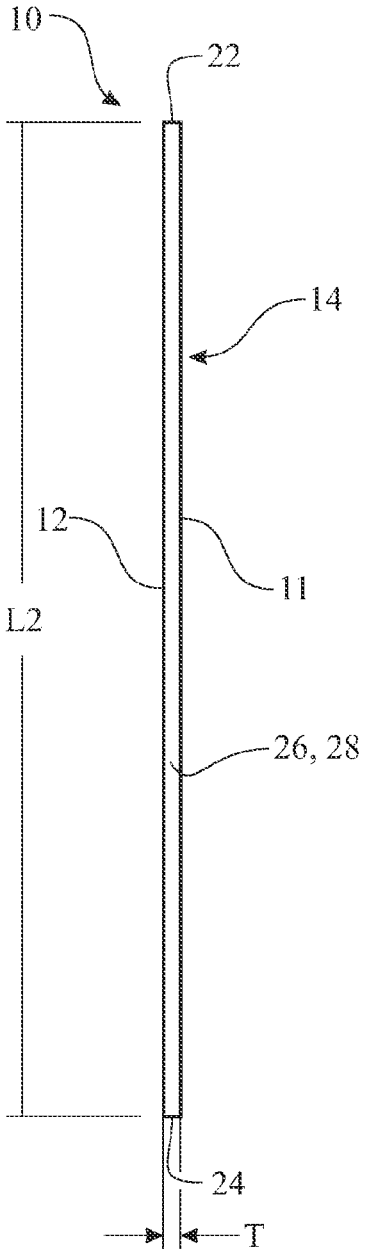
FIG. 2 presents a side view of the portable protection device originally introduced in FIG. 1.
Figure 3:
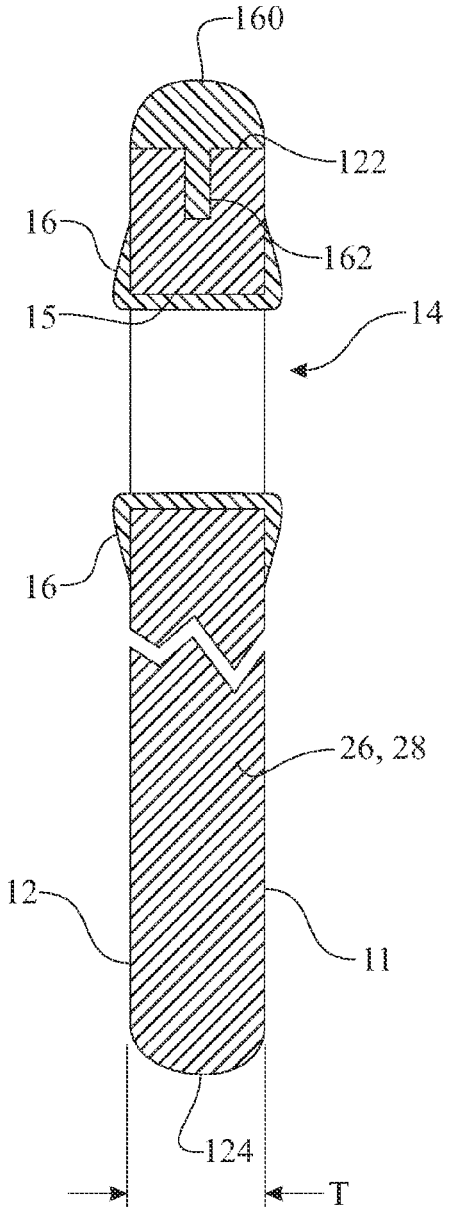
FIG. 3 presents an enlarged, sectioned side view of the portable protection device originally introduced in FIG. 1, introducing various optional end configurations, the section being taken along section line 3-3 of FIG. 1.

The rectangular board 14 may be fabricated of a laminated material, a molded material, an extruded material, or any other reasonable material to form a generally, rectangular board 14. Examples of materials that can be used to fabricate the board 14 include any one of a polymer material, plastic, fiberglass, polyvinyl chloride (PVC), a rigid rubber, a thick vinyl, thermoplastic, thermosetting plastic, polypropylene, polytetrafluoroethylene, polycarbonate, Perspex, Plexiglas or any other hard-impact resistant plastic having high tensile strength. It is preferred that the portable protective barrier 10 is fabricated of a recycled plastic, such as Polyethylene Terephthalate, High Density Polyethylene, and the like. The recycling process can introduce a dye to provide a more consistent color. Other materials which can be used include wood, composites such as fiberglass, Kevlar®, carbon fiber, and the like. The peripheral edge 20 of the rectangular board 14 is preferably shaped by rounding or chamfering the corners as illustrated in FIGS. 1 and 3. An edging finish 160 may be applied to and circumscribing the peripheral edge 20 of the rectangular board 14 to provide additional protection. The edging finish 160 may be fabricated of a plastic, rubber, or other protective or complaint material. The edging finish 160 can be attached to the rectangular board 14 using a tongue and slot interface 162, or any other reasonable attachment design. Alternatively, the peripheral edge 20 of the rectangular board 14 can be shaped in any reasonable geometry, as best illustrated by the exemplary shaped edge 124. The exemplary shaped edge 124 can be formed by a pair of round over bits, a beading bit, and the like. It is understood that the shaped edge 124 can be any reasonable cross-sectioned shape, including chamfered, scalloped, ogee, and the like.

Figure 5:
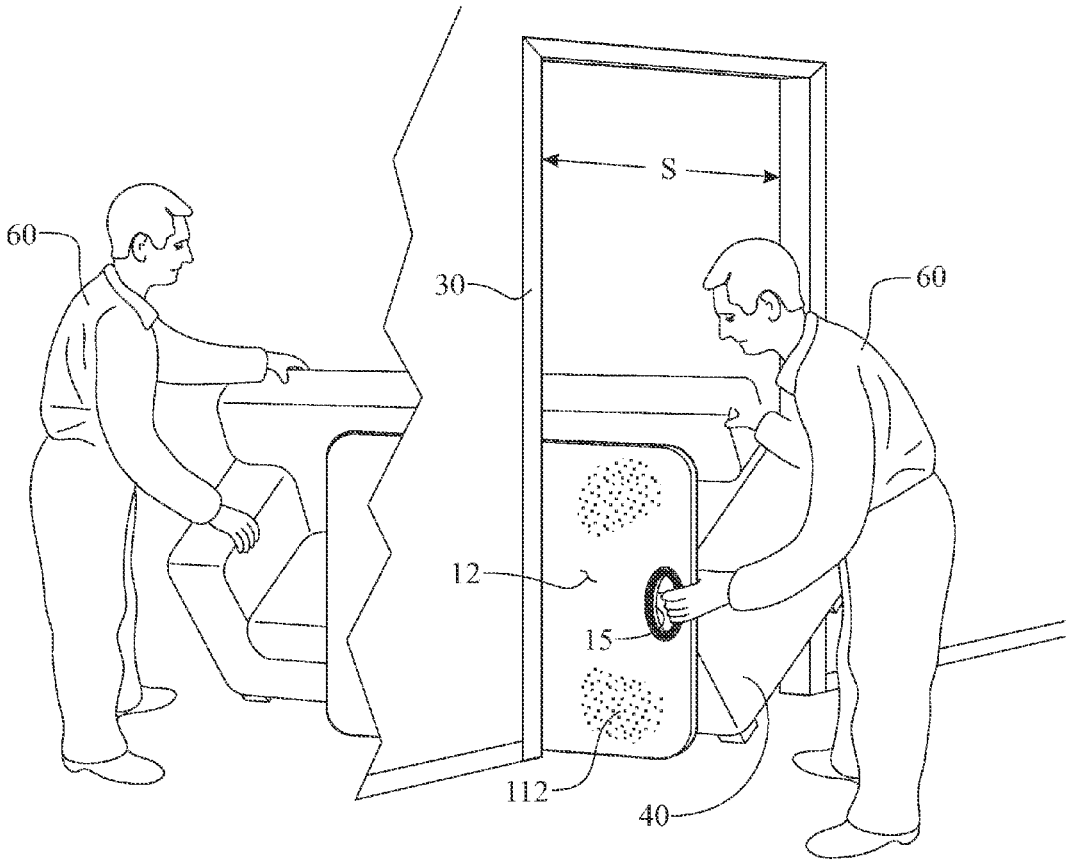
FIG. 5 presents a perspective view illustrating an exemplary application of the portable protection device for facilitating the delivery or moving of an oversized article, wherein the portable protection device is inserted between a doorjamb and a sofa to prevent damage to both items.
Figure 6:
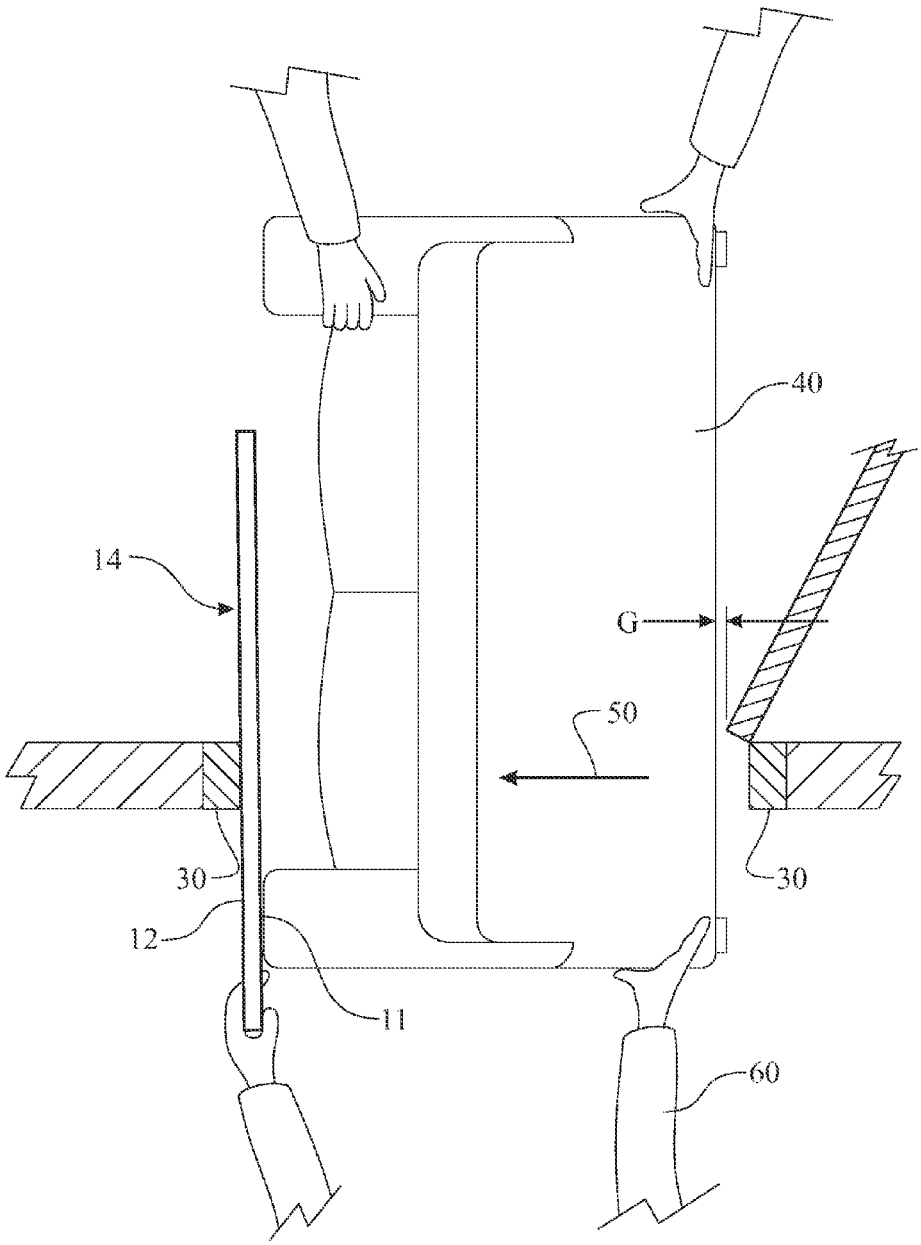
FIG. 6 presents a top view of the exemplary application of the portable protection device, originally presented in FIG. 5, introducing a compression force to aid in the passage of the article through any tight spans.

The portable protective barrier 10 includes a handle, denoted by reference number 15 in FIG. 1, for transporting the portable protective barrier 10 by hand from place to place, and for physically positioning the portable protective barrier 10 during use, as better illustrated in FIGS. 5 and 6. The handle 15 is created by forming a full depth cut completely through the board 14 as illustrated in FIG. 3. The handle 15 is located adjacent to a first edge of the board 14. An optional reinforcement material 16 may be disposed about the circumference or perimeter of the cut out to provide additional comfort to the user when gripping the handle 15. The reinforcement material 16 may be fabricated of any reasonable material, such as plastic, rubber, metal, fabric, leather, and the like. The reinforcement material 16 may also include a foam material to cushion a user's grip when holding the portable protective barrier 10.

Figure 4:
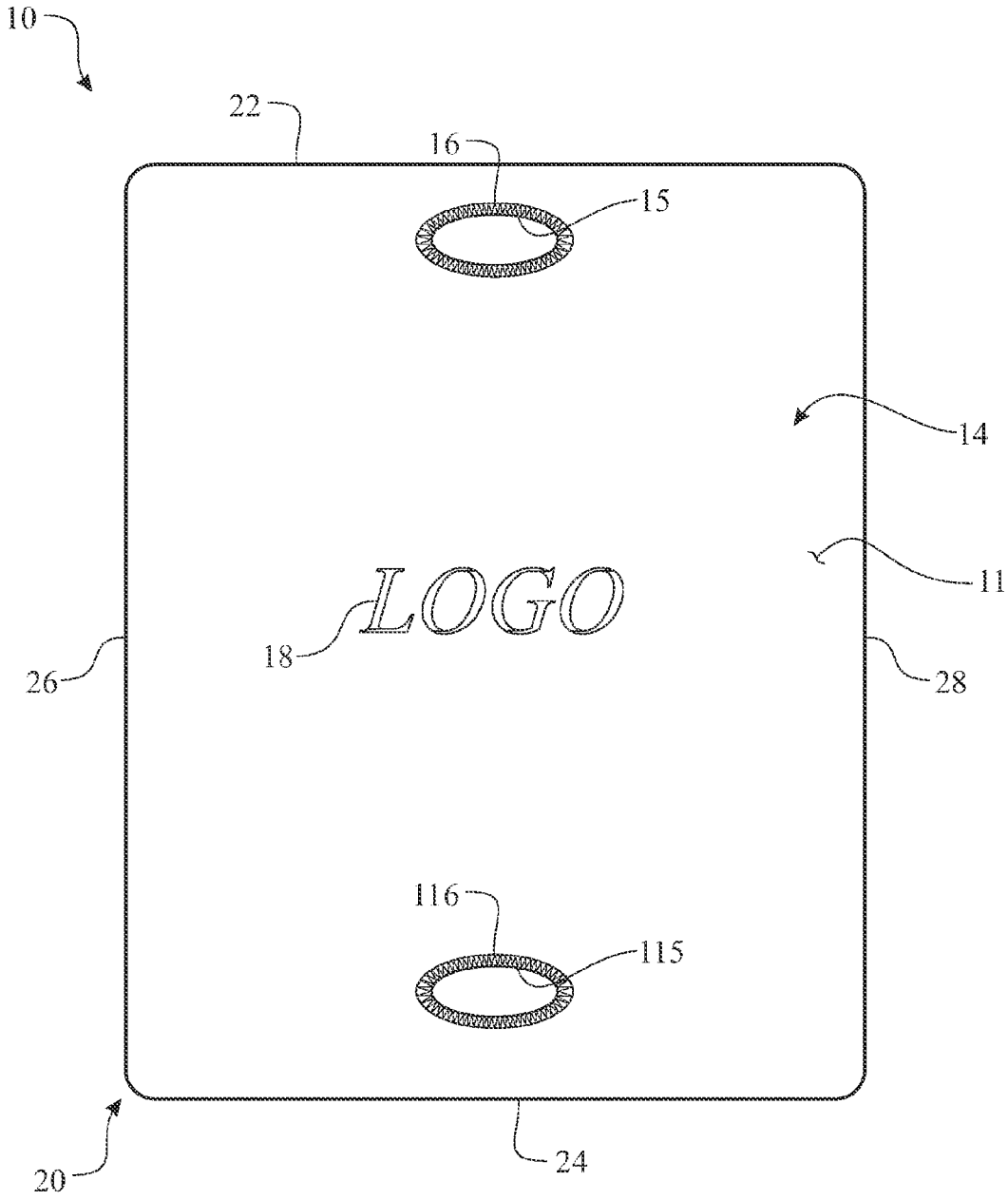
FIG. 4 presents a front plan view of the portable protection device originally introduced in FIG. 1, the portable, protection device introducing a pair of handles.

Although the handle 15 is shown to have an oval shape, it may be formed having any reasonable geometric shape. For example, handle 15 may be round, rectangular, or elliptical. The handle 15 is preferable sized and located to best suit handling during use. In one alternative embodiment, portable protective barrier 10 may include a second handle 115 (shown in FIG. 4) formed by a second full depth cut out through the board 14, where the second handle 115 is aligned with the first handle 15, but situated adjacent a second edge of board 14. The second handle 115 can optionally include a second reinforcement material 116 as previously described herein. The two handles 15, 115 provide a combinational benefit of allowing multiple movers, each standing on an opposite side of a doorway, the option of maneuvering the portable protective barrier 10 between the article being moved and a doorjamb 30, as better illustrated in FIG. 5.

The board 14 can be fabricated having any reasonable dimensions. Examples of preferred sizes include a length of 24, 36, 48, or 52 inches and a width of 24, 36, 48 or 52 inches. The length and width of the board 14 can be the same or different. The board is preferably of a thickness allowing flexure during use and would be based upon the material selected for fabrication while taking weight into consideration. It should be noted that the specified dimensions provided herein are for illustrative purposes only, and the function or practice of the present invention is not limited by any specific dimension.

The portable protective barrier 10 may be fabricated of any known geometrical shape including a square, oval, round, triangular, hexagonal, trapezoidal, scalloped or any other reasonable shape. The portable protective barrier 10 can also be fabricated of any freeform shape. The freeform shape allows the designer to integrate the handles 15, 115 into the shape of the peripheral edge 20, if so desired.

Indicia 18, advertising, markings, corporate logos, or any other indicia may be disposed anywhere on the outer surface of the board 14. For example, moving companies or packaging companies may wish to promote their products and services by placing advertisements on the outer surface of the board 114. Similarly, furniture manufactures may have a desire to promote their company as such.

The portable protective barrier 10 includes a durable board 14 having two opposite side surface 11, 12. At least one of the side surface 11, 12 is fabricated having a smooth, slippery finish. The smooth, slippery finish may be formed while fabricating the board 14, or alternatively, a slippery, smooth finish may be achieved by adhering or laminating one or more sheets to one or both of the surface of sides 11, 112 of the board 14. The sheets may comprise a thin plastic, polyethylene, polystyrene, vinyl material, and the like. The material may be heat bonded, adhesively bonded, or laminated to the sides 11, 12. Alternatively, paint, epoxy, resins, or other material may be applied to the surface of the sides 11, 12 to create the desired smooth finish. As a result of the smooth, slippery surfaces, when the furniture 40 frictionally engages either of the sides 11, 12 of the portable, protective barrier 10, the furniture simply slides across the sides 11, 12 with ease, allowing the movers' to efficiently move the furniture 40 through a tight span such as a doorway 30.

In an alternative embodiment, the portable, protective barrier 10 may include a board 14 having one side surface 11, 12 that includes a non-skid texture 112 (FIG. 5) where the non-skid texture 112 helps to hold the portable, protective barrier 10 in place during use to prevent the portable, protective barrier 10 from shilling out of place or sliding as furniture 40 frictionally engages with the portable, protective barrier 10 and slides along in a generally longitudinal direction. The non-skid textured surface 112 may be formed by placing foam, rubber, grit, or any other frictional material onto the desired surface 12 of the board 14. The non-skid texture 112 may be applied as a sheet, a series of small dimples, ridges, a spray, or any other reasonable format thereof.

Turning now to FIGS. 5 and 6, there are shown a perspective view and top view on a method of using the portable, protective barrier 10, in accordance with one embodiment of the present invention.

The portable, protective barrier 10 is generally used for enhancing movement and protecting an article being moved when the article passes through a span, such as a piece of furniture 40 passing through a doorjamb 30, as illustrated in FIGS. 5 and 6. The furniture 40 is exemplary for any article being moved. The doorjamb 30 is exemplary for any structural feature or other item forming a span referenced by "S". In use, an individual 60 grasps the portable, protective barrier 10 in one hand, by gripping handle 15, and places the portable, protective device 10 between one edge of the doorjamb 30 of a doorway and the furniture 40 forming a barrier therebetween. The portable, protective barrier 10 is positioned such that one side 11 of the portable, protective barrier 10 faces the furniture 40 and the second, opposite side 12 of the portable, protective barrier 10 faces the doorjamb 30, as better illustrated in FIG. 5. The pressure exerted on the portable, protective barrier 10 by furniture 40 causes the portable, protective barrier 10 to remain in place while the furniture 40 slides across the slippery surface of side surface 11, thus easily passing through the doorway. The portable, protective barrier 10 creates a barrier between the doorjamb 30 and the furniture 40 protecting the doorjamb 30 and furniture 40 from any damage. In the absence of the portable protective barrier 10, the furniture 40 would rub directly against the doorjamb 30 possibly causing tears, snags, scuffs, or leaving score marks, or dents in the furniture 40 or doorjamb 30. Also without the benefit of the board's 14 slippery surface, it makes moving furniture 40 through doorways more difficult. It is also recognized that multiple portable, protective devices, 10 may be used if necessary during the move. For example, two protective devices 10 may be implemented, where one portable, protective barrier 10 is placed between the furniture 40 and a left doorjamb 30, and another portable, protective barrier 10 is placed between the furniture 40 and a right doorjamb 30, where one person 60 can operatively position a first portable, protective barrier 10 in place, and a second individual 60 can operatively situate a second portable, protective barrier 10 in place. In this scenario, the furniture 40 and the doorjamb 30 are each protected on both sides.

The portable, protective barrier 10 provides an additional benefit, wherein the portable, protective barrier 10 enables the mover to apply a compression force 50 to the article (such as the furniture 40). The compression force 50 positions the article 40 against the portable, protective barrier 10 optimizing the space formed between the article 40 and the opposite side of the spanned opening. Additionally, when moving objects such as furniture 40, the compression force compacts the furniture 40, thus additionally increasing the gap (referenced as "G" in FIG. 6) on the opposite side. The present invention offers a portable protective barrier 10 that is quickly and easily inserted between furniture and structural elements such as doors, doorways, doorjambs, and walls, to prevent damage when moving the furniture. The portable, protective barrier 10 is lightweight, easy to transport and carry, and can be constructed from recyclable plastic.

Although the disclosure presents retaining the portable protective barrier 10 in position by gripping the handle 15, 115, it is understood that a retention feature or element may be utilized for temporarily securing or retaining the portable protective barrier 10 in location while passing articles nearby.

Figure 7:
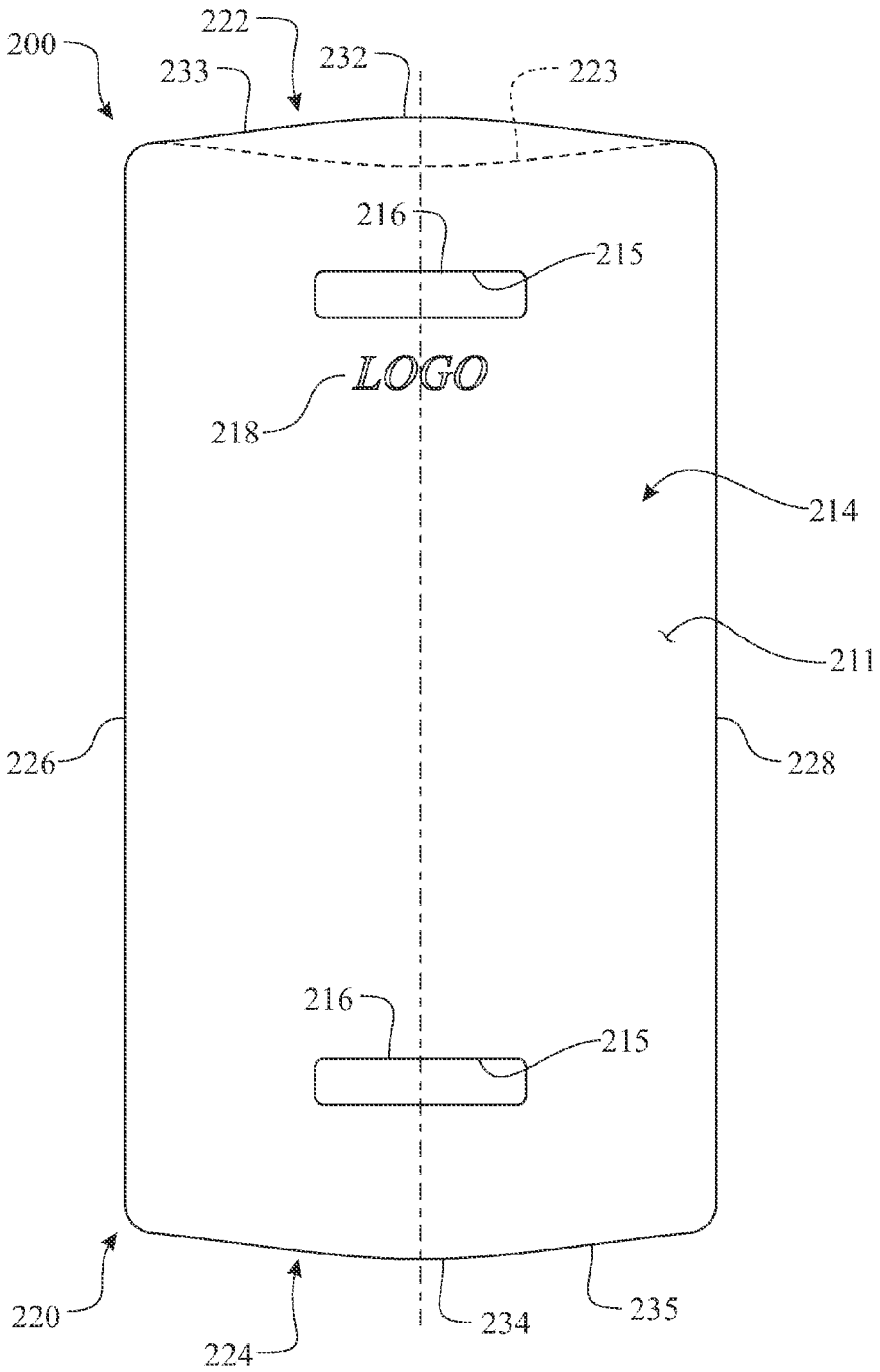
FIG. 7 presents a front elevation view of a second exemplary portable protection device.
Figure 8:
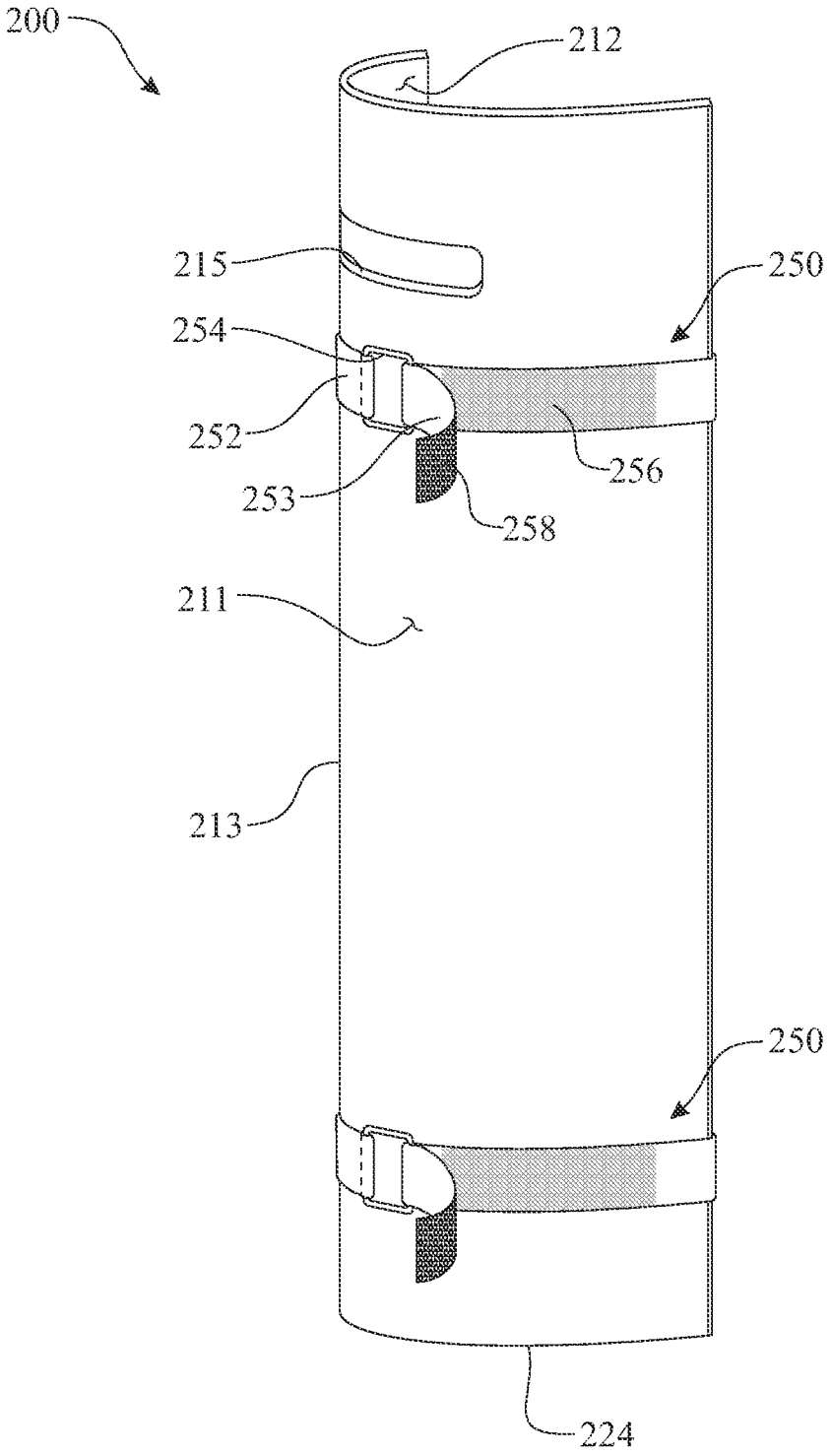
FIG. 8 presents an isometric side view of the second exemplary portable protection device of FIG. 7, introducing a forming function.

In a second embodiment, the portable protective barrier 10 can be extended in length and/or narrowed and subsequently formed as illustrated in FIGS. 7 and 8. The modified sized and shaped portable protective barrier 10 is referred to as a self supporting protective barrier 200. Like features of the self supporting protective barrier 200 and the portable protective barrier 10 are numbered the same except preceded by the numeral '2'. The self supporting protective barrier 200 is initially fabricated in a manner similar to the portable protective barrier 10 as described above. A handle 215 is preferably formed through the material proximate one or more edges of the self supporting protective barrier 200. The self supporting protective barrier 200 is fabricated of a material having a shape memory. The self supporting protective barrier 200 is formed into a desired arched shape by bending the self supporting protective barrier 200 by bringing two parallel edges towards one another, then retaining the arched shaped by placing one or more shaping straps 250 about the formed self supporting protective barrier 200. The arched shape of the self supporting protective barrier 200 defines an exterior arched surface 211 and an interior arched surface 212. The memory of the material retains the desired arched section 213. The arched shaped along either of the two edges can be used as a supporting edge 216, which will be described in detail in FIGS. 9 and 10.

The shaping strap 250 can be of any form factor. The exemplary shaping strap 250 includes a strap 252 attached to one edge of a strap buckle 254. A first dense hook and loop tape section 256 is disposed upon one side of a section of the strap 252 at a location for engagement with a second dense hook and loop tape section 258 disposed upon the same side of the strap 252 along a strap securing end 253. The user would insert the second dense hook and loop tape section 258 through an aperture formed through the strap buckle 254 and return towards the first dense hook and loop tape section 256. The user would pull the strap 252 taught and engage the second dense hook and loop tape section 258 with the first dense hook and loop tape section 256. The shaping strap 250 is adjustable, enabling variation in the radius of the arched section 213.

As illustrated, it is desirable to utilize a plurality of shaping straps 250 placed in a spatial arrangement along a length of the self supporting protective barrier 200. The user would determine a reasonable quantity of shaping straps 250 to ensure a continuous arch along the length of the self supporting protective barrier 200.

Figure 9:
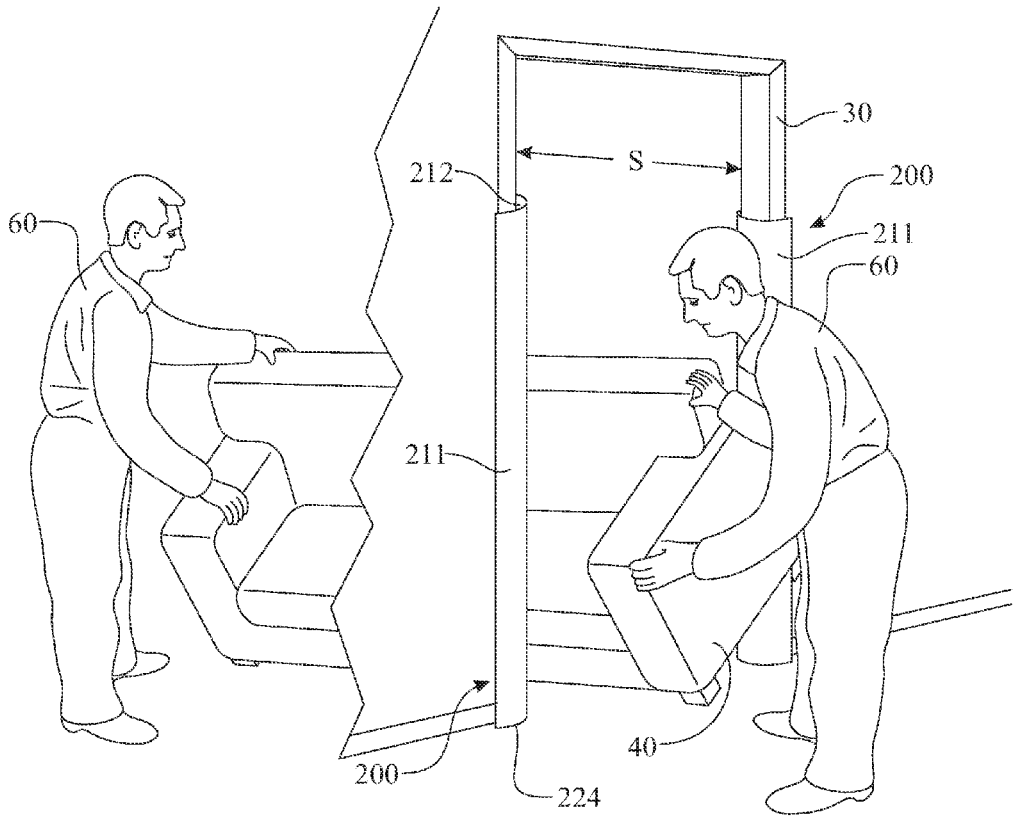
FIG. 9 presents an perspective view of an exemplary application of the second formed portable protection device for facilitating the delivery or moving of an oversized article, wherein the portable protection device is formed and positioned about a doorjamb to prevent damage to a sofa and the doorjamb during passage of the sofa therethrough.
Figure 10:
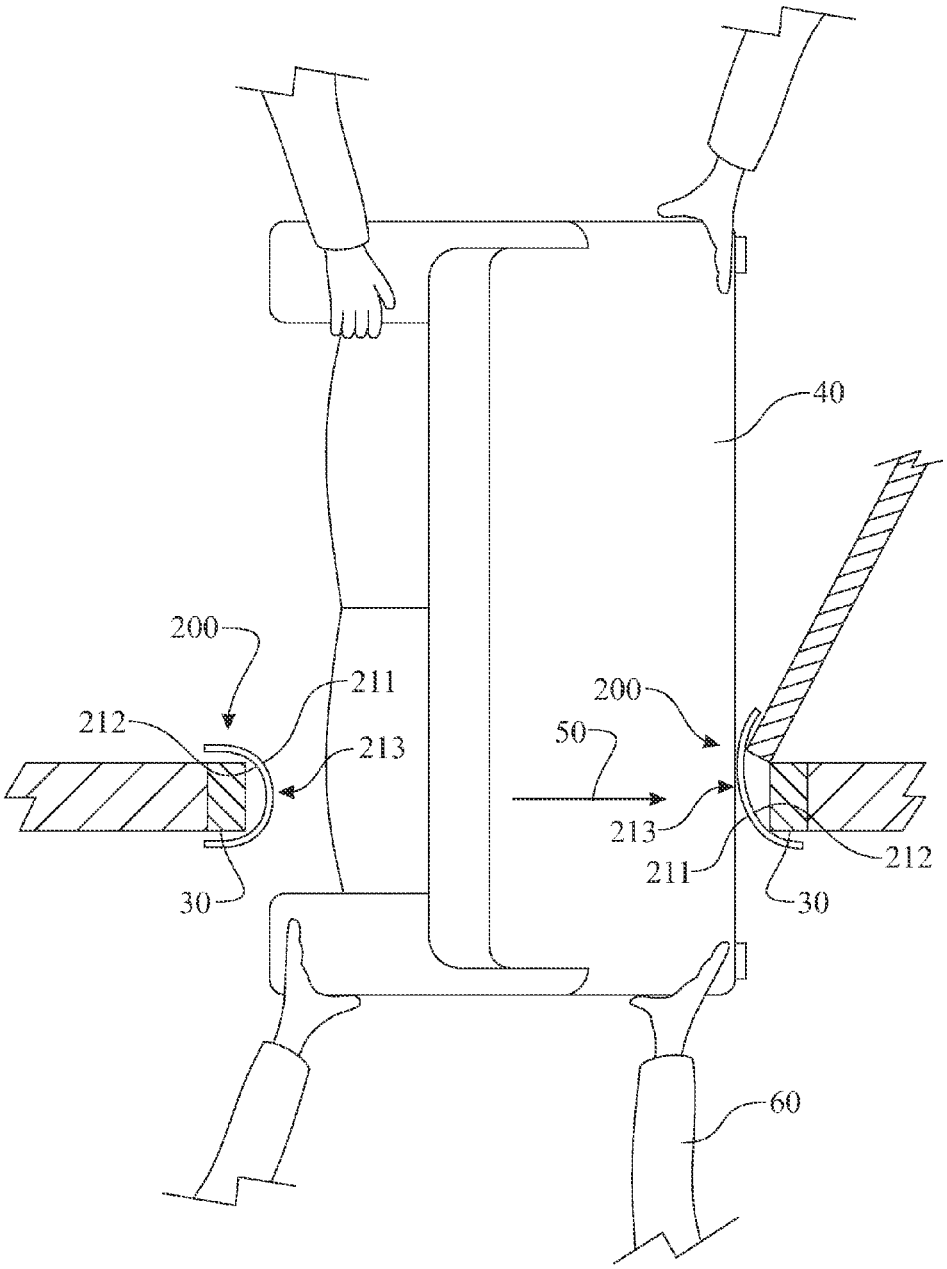
FIG. 10 presents a top view of the exemplary application of the portable protection device, originally presented in FIG. 9, introducing a compression force to aid in the passage of the article through any tight spans.

An exemplary application of the self supporting protective barrier 200 is illustrated in FIGS. 9 and 10. The self supporting protective barrier 200 enables protection of edges of a passageway, a doorway, appliances, and the like, without the requirement of support from the mover. The arched shape aids in protecting the cornered surface of the object as well as providing a supporting edge 216, which is placed upon the ground. The arched section 213 adds rigidity to an otherwise planar and flexible sheet of material. The arched section 213 defines a center of gravity located above a plane formed along the supporting edge 216 by the arched shape. The arched geometry creates a significantly more stable apparatus compared to a planar sheet of material standing on edge. The supporting edge 216 supports the self supporting protective barrier 200 in an upright orientation.

The interior arched surface 212 is placed against the doorway 30 and the supporting edge 216 is set upon the floor. The arch may be adjusted as needed. One exemplary application is when the self supporting protective barrier 200 is placed about a door as illustrated in FIG. 10.

It would be preferred to place one self supporting protective barrier 200 along each edge of the opening or doorway 30 as illustrated in FIGS. 9 and 10. The workers 60 would lightly compress 50 the furniture 40 (or other object being moved) against either of the self supporting protective barriers 200. The slight compression retains the self supporting protective barrier 200 in position. The self supporting protective barrier 200 protects both the doorway 30 and the furniture 40 from damage.

The lower edge 224 is used to support the self supporting protective barrier 200 during use. The lower edge 224 can be shaped to tilt an upper edge of the self supporting protective barrier 200 towards a radial center of the arch of the self supporting protective barrier 200 as illustrated in FIG. 7. The lower edge 224 can include a lower edge peak segment 234 proximate a center thereof, with a lower edge draft segment 235 extending between the lower edge peak segment 234 to each side edge 226, 228. The lower edge peak segment 234 would define a farthest distance from a center point of the self supporting protective barrier 200. The lower edge draft segment 235 provides a linear or curved edge extending between the lower edge peak segment 234 and each side edge 226, 228, wherein the transition between the lower edge peak segment 234 and each edge 226, 228 is at a distance from the center point of the self supporting protective barrier 200 is shorter than the distance between the lower edge peak segment 234 and the center point. The lower edge peak segment 234 and lower edge draft segment 235 can be fabricated of two or more linear sections, a continuous arched section, or any combination thereof.

An upper edge 222 is provided at an opposite end of the self supporting protective barrier 200. The upper edge 222 can be linear as illustrated in the portable, protective device 10, include a shape mirroring the lower edge 224, or a shape contouring with the lower edge 224. In the mirrored configuration, the lower edge 224 includes an upper edge peak segment 232 proximate a center thereof, with an upper edge draft segment 233 extending between the upper edge peak segment 232 to each side edge 226, 228. This enables the user to use either the upper edge 222 or the lower edge 224 as the supporting edge. In the contouring configuration, the upper edge 222 is shaped having an alternate upper edge 223. The alternate upper edge 223 maximizes the utilization of the material, wherein the alternate upper edge 223 is formed by cutting the material to form the lower edge 224 of an adjacent panel. When an arched section 213 is formed into the self supporting protective barrier 200, the lower edge peak segment 234 would be located centrally along the arched section 213. This causes the self supporting protective barrier 200 to lean rearward when placed upon the supporting edge.

The self supporting protective barrier 200 can be stored in either an arched configuration, whereby the self supporting protective barrier 200 is retained by shaping straps 250 or in a planar configuration, where the self supporting protective barrier 200 would be supported by a planar surface, such as a floor, a wall, a board, and the like.

It will be appreciated that although the exemplary embodiment of the present invention is directed towards the use of the portable, protective barrier 10 for moving furniture 40, the portable protective barrier 10 can also be used in a number of different applications such as protecting tile floors, tabletops, or countertops from damage due to items that are inadvertently dropped on such surfaces such as tools, buckets, hammers, or other objects that may fall on a floor, tabletop or countertop and chip, break, crack, scratch or damage the surfaces thereof.

For example, the portable, protective barrier 10 may be used as a protective barrier on a countertop or tabletop and the non-skid texture prevents the portable, protective barrier 10 from sliding off the table or counter.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What we claim is:

1. A method of facilitating movement of an object through a space provided between two barriers, said method comprising the steps of:

obtaining a portable protective barrier comprising a planar board fabricated of a plastic material having a shape memory, said planar board having a peripheral edge defining two opposite surfaces;

bending said portable protective barrier forming a bent portable protective barrier comprising an arched section defining an exterior surface being on a convex arched surface and defining an interior surface being on a concave arched surface, wherein said shape memory retains said arched section;

supporting said portable protective barrier by placing a lower edge of said portable protective barrier upon a ground surface;

positioning said interior surface of said portable protective barrier against one of said two barriers and supporting said portable protective barrier by placing said interior surface in contact with each of two corners of said one of said two barriers, wherein said arched section provides flexure when a force is applied to said convex arched surface;

using a resulting shape of said arched section to support said bent portable protective barrier in position by placing a lower edge of said bent portable protective barrier against a floor and said direct engagement between said interior surface and said corner of one of said two barriers to retain said bent portable protective barrier in position; and transporting at least one large object compressing one side of said object against said placed portable protective barrier to facilitate movement of the object through said space.

2. A method of facilitating movement of an object through a space provided between two barriers as recited in claim 1, said method comprising the additional step of:

providing a low friction interface between the portable protective barrier and the at least one large item by providing said exterior surface of said portable protective barrier with a smooth, slippery texture.

3. A method of facilitating movement of an object through a space provided between two barriers as recited in claim 1, further comprising a step of placing said arched portable protective barrier against a planar surface to return said portable protective barrier to a planar shape.

4. A method of facilitating movement of an object through a space provided between two barriers as recited in claim 1, said method comprising the additional step of:

providing a shape memory by fabricating said portable protective barrier of any one of plastic, recyclable plastic, polyvinyl chloride, vinyl, thermoplastic, thermosetting plastic, polycarbonate, polypropylene, polyurethane, and any combination thereof.

5. A method of facilitating movement of an object through a space provided between two barriers as recited in claim 1, wherein said step of bending said portable protective barrier forming an arched section is accomplished by placing at least one strap about said portable protective barrier when said portable protective barrier is bent defining said arched shape.

6. A method of facilitating movement of an object through a space provided between two barriers as recited in claim 5, wherein said step of placing at least one strap about said portable protective barrier further comprises placing a plurality of straps in a spatial arrangement about said portable protective barrier when said portable protective barrier is bent defining said arched shape.

7. A method of facilitating movement of an object through a space provided between two barriers, said method comprising the steps of:

obtaining a portable protective barrier comprising a planar board fabricated of a plastic material having a shape memory, said planar board having a peripheral edge defining two opposite surfaces;

bending said portable protective barrier forming a bent portable protective barrier having an arched section defining an exterior surface being on a convex arched surface and defining an interior surface being on a concave arched surface;

retaining said arched section of said bent portable protective barrier in shape by positioning at least one adjustable strap about said bent portable protective barrier for a period of time;

removing each of said at least one adjustable straps from said bent portable protective barrier, wherein said shape memory retains said arched section;

supporting said portable protective barrier by placing a lower edge of said portable protective barrier upon a ground surface;

positioning said interior surface of said portable protective barrier against one of said two barriers, wherein said interior surface is positioned contacting two corners of said one of said two barriers and said arched section provides flexure when a force is applied to said convex arched surface;

using a resulting shape of said arched section to support said bent portable protective barrier in position by placing a lower edge of said bent portable protective barrier against a floor and said direct engagement between said interior surface and said corner of one of said two barriers to retain said bent portable protective barrier in position; and transporting at least one large object compressing one side of said object against said placed portable protective barrier to facilitate movement of the object through said space.

8. A method of facilitating movement of an object through a space provided between two barriers as recited in claim 7, said method comprising the additional step of:

providing a low friction interface between the portable protective barrier and the at least one large item by providing said exterior surface of said portable protective barrier with a smooth, slippery texture.

9. A method of facilitating movement of an object through a space provided between two barriers as recited in claim 7, wherein said step of placing at least one adjustable strap about said portable protective barrier further comprises placing a plurality of adjustable straps in a spatial arrangement about said portable protective barrier when said portable protective barrier is bent defining said arched shape.

10. A method of facilitating movement of an object through a space provided between two barriers as recited in claim 7, further comprising a step of placing said arched portable protective barrier against a planar surface to return said portable protective barrier to a planar shape.

11. A method of facilitating movement of an object through a space provided between two barriers as recited in claim 7, said method comprising the additional step of:

providing a shape memory by fabricating said portable protective barrier of any one of plastic, recyclable plastic, polyvinyl chloride, vinyl, thermoplastic, thermosetting plastic, polycarbonate, polypropylene, polyurethane, and any combination thereof.

12. A method of facilitating movement of an object through a space provided between two barriers, said method comprising the steps of:

obtaining a portable protective barrier comprising a planar board fabricated of a plastic material having a shape memory, said planar board having a peripheral edge comprising an upper edge, a lower edge, a first side edge and a second side edge, said lower edge comprising a centrally located peak segment extending further from a center of the planar board compared to each corner located between said lower edge and each of said first side edge and second side edge, said peripheral edge defining two opposite surfaces;

bending said portable protective barrier forming an arched section which is centered along an approximate center of said centrally located peak segment, said portable protective barrier comprises an exterior surface being on a convex arched surface and defining an interior surface being on a concave arched surface, wherein said shape memory retains said arched section;

placing said centrally located peak segment into one of a supporting surface and a floor proximate one of said two barriers, wherein said centrally located peak segment causes said portable protective barrier to lean towards said interior surface;

positioning said interior surface of said portable protective barrier in contact with each of two corners of said one of said two barriers, wherein said arched section provides flexure when a force is applied to said convex arched surface; and transporting at least one large object through said space by compressing one side of said at least one large object against said placed portable protective barrier to facilitate movement of the object through said space.

13. A method of facilitating movement of an object through a space provided between two barriers as recited in claim 12, said method comprising the additional step of:

providing a low friction interface between the portable protective barrier and the at least one large item by providing said exterior surface of said portable protective barrier with a smooth, slippery texture.

14. A method of facilitating movement of an object through a space provided between two barriers as recited in claim 12, further comprising a step of placing said arched portable protective barrier against a planar surface to return said portable protective barrier to a planar shape.

15. A method of facilitating movement of an object through a space provided between two barriers as recited in claim 12, said method comprising the additional step of:

providing a shape memory by fabricating said portable protective barrier of any one of plastic, recyclable plastic, polyvinyl chloride, vinyl, thermoplastic, thermosetting plastic, polycarbonate, polypropylene, polyurethane, and any combination thereof.

16. A method of facilitating movement of an object through a space provided between two barriers as recited in claim 12, wherein said step of bending said portable protective barrier forming an arched section is accomplished by placing at least one strap about said portable protective barrier when said portable protective barrier is bent defining said arched shape.

17. A method of facilitating movement of an object through a space provided between two barriers as recited in claim 16, wherein said step of placing at least one strap about said portable protective barrier further comprises placing a plurality of straps in a spatial arrangement about said portable protective barrier when said portable protective barrier is bent defining said arched shape.

* * * * *